US005922269A

United States Patent [19]

Gronnevik et al.

[11] Patent Number: 5,922,269

[45] Date of Patent: Jul. 13, 1999

[54] PLASTIC PALLET

[75] Inventors: Oddbjorn Gronnevik, Nesbru; Helge Grande; Rolf Kotterheinrich, both of Stathelle, all of Norway

[73] Assignee: Borealis A/S, Lyngby, Denmark

[21] Appl. No.: 08/739,643

[22] Filed: Oct. 30, 1996

Related U.S. Application Data

[60] Provisional application No. 60/013,398, Mar. 14, 1996.

[30] Foreign Application Priority Data

Mar. 6, 1996 [NO] Norway ..... 960910

[51] Int. Cl.[6] ..... B29C 43/00

[52] U.S. Cl. ..... 264/500; 264/241; 264/510; 264/512; 264/514; 264/531; 264/540; 264/543

[58] Field of Search ..... 108/51.1, 51.3; 428/172; 264/171.12, 500, 454, 510, 512, 514, 531, 540, 543, 241, 523

[56] References Cited

U.S. PATENT DOCUMENTS

| | | | |
|---|---|---|---|
| 2,503,022 | 4/1950 | Benoist et al. | 248/120 |
| 3,667,403 | 6/1972 | Angelbeck, Jr. | 108/58 |
| 3,719,157 | 3/1973 | Arcocha et al. | 108/51 |
| 3,868,915 | 3/1975 | Hafner | 108/51 |
| 3,880,092 | 4/1975 | Seeber et al. | 108/55 |
| 3,915,098 | 10/1975 | Nania | 108/51 |
| 3,938,448 | 2/1976 | Nishitani et al. | 108/58 |
| 4,007,694 | 2/1977 | Fowler | 108/55.1 |
| 4,397,246 | 8/1983 | Ishida et al. | 108/55.3 |
| 4,397,247 | 8/1983 | Lemelson | 108/57.1 |
| 4,874,649 | 10/1989 | Daubenbuchel et al. | 428/36.5 |
| 5,046,434 | 9/1991 | Breezer et al. | 108/51.1 |
| 5,052,307 | 10/1991 | Morrison | 108/53.1 |
| 5,417,167 | 5/1995 | Sadr | 108/51.1 |
| 5,555,820 | 9/1996 | Shuert | 108/561 |

FOREIGN PATENT DOCUMENTS

| | | |
|---|---|---|
| 0 400 640 | 5/1990 | European Pat. Off. . |
| 226505 | 6/1997 | European Pat. Off. . |
| 2612153 | 9/1988 | France . |
| 385 207 | 1/1976 | Sweden . |
| 501 539 | 3/1995 | Sweden . |
| 685549 A5 | 10/1992 | Switzerland . |
| 1292136 | 10/1972 | United Kingdom . |
| WO 93/18906 | 9/1993 | WIPO . |

*Primary Examiner*—Donald Loney
*Attorney, Agent, or Firm*—Kirkpatrick & Lockhart LLP

[57] ABSTRACT

A method of manufacturing a plastic pallet having a deck and legs underneath the deck includes forming an extruded parison, while still hot, into an article having a pallet deck and integrated sheet legs along its longitudinal, transverse, or both sides. The formed article is removed from the mold and the formed sheet legs are brought into a position perpendicular to the pallet deck and then are fastened in that position.

17 Claims, 3 Drawing Sheets

PLASTIC PALLET

This application claims benefit of Provisional Application Ser. No. 60/013,398 filed Mar. 14, 1996.

FIELD OF INVENTION

This invention relates to a method of manufacturing a plastic pallet, in particular a pallet having integrated sheet-like legs along the sides of the pallet.

PRIOR ART

Pallets are included as a part of the goods that are to be transported and/or stored on them, and therefore it is important for the pallet to be lightweight, but strong and rigid at the same time. Plastic pallets have the advantages over wooden pallets that they are lightweight, that they do not absorb moisture, and that they can be cleaned/disinfected, which is decisive in fields where hygiene is important, e.g., in the food industry. Such pallets have to have a smooth surface without nearly inaccessible parts where dirt can collect.

European Patent No. EP-0 400 640 discloses a plastic pallet that is assembled from a top deck and a bottom deck with runners, or from a deck and runners. The components are formed with legs that are inserted into one another during assembly. Mechanical fasteners in the form of metal plates having die-cut notches, nails or the like can be employed in order to ensure that the components hold together. Both the top deck and bottom deck are constructed with exposed stiffening reinforcing ribs.

Swiss Patent No. CH-685549 A5 discloses a plastic pallet that is injection molded in two components, namely, a top deck and a bottom deck comprising posts and runners. The top deck and the bottom deck have reinforcing ribs running both transversely and longitudinally, in a rectangular pattern. The top deck and bottom deck are butt-welded together so that the side edges and ribs get to be welded together against one another.

Directly within all four side edges and in the center longitudinally there are in the ribs semicircular openings into which steel pipes or flat rods can be jammed for mechanical reinforcement of the pallet. The plastic pallet is preferably fabricated from polyethylene, and it is designed for use, among other things, in the food and pharmaceuticals industry.

Prior art plastic pallets are fabricated by the injection molding of components that are then joined together. The components will typically have reinforcing ribs at required places in order to attain a lightweight rigid construction. In the injection molding of such large objects, very large expensive injection molding tools are used that require large injection molding machines having great clamping force. Consequently, it would be desirable to be able to make plastic pallets by a simpler and more economical method. A possible means of attaining this object is to thermo-form the pallet from an extruded sheet of plastic or parison, like the blow molding of large objects such as barrels, gasoline tanks, etc. To attain a lightweight and rigid construction it is often desirable to employ a coextruded multilayer structure where one of the layers is at least partially foamed. For instance, U.S. Pat. No. 4,874,649 discloses a method for the blow molding of a coextruded parison comprising at least two layers, one of which, perhaps more, is at least partially foamed.

Applicant's contemporary Norwegian patent application NO-A960128 relates to a pallet manufactured by thermo-forming a parison of the type disclosed in U.S. Pat. No. 4,874,649. Said parison is formed into a pallet deck and runner components, which are assembled in a subsequent separate operation. Thus a lightweight, but strong and rigid construction, is attained. The pallet may be reinforced by introducing rigid sections into cavities formed between the pallet deck and runners.

For many purposes lightweight pallets, often of a smaller size than standardized pallets, are desired. It has now been found that it is possible to manufacture a pallet by a simplified production method by which the entire pallet is manufactured from the same material as disclosed in Applicant's above mentioned patent application, but with pallet legs of a simplified construction.

SUMMARY OF THE INVENTION

The present invention provides a method of manufacturing a plastic pallet comprising a deck and legs underneath said deck, comprising forming in one step in a mold an extruded parison, while hot, into one predominantly flat article comprising a pallet deck and integrated sheet legs along the longitudinal and/or transverse sides of said pallet deck, then the formed article is removed from the mold and the formed sheet legs are brought into a position perpendicular to the pallet deck and fastened in said position.

In one embodiment of the pallet fabricated by the method of the invention, the pallet has sheet legs along its longitudinal sides, alternatively transverse sides, and on the bottom part of the pallet deck in its center longitudinally and parallel to said formed sheet legs there are in addition formed two or more block-shaped posts which function as the load-carrying pallet legs.

In a further embodiment of the pallet manufactured by the method of the invention, instead of said bloc-shaped posts a continuous U-shaped profile is formed, and to the bottom of said profile a separately manufactured pallet leg structure comprising an upper and lower runner component, is fastened.

DETAILED DESCRIPTION OF THE INVENTION

Figure 1:
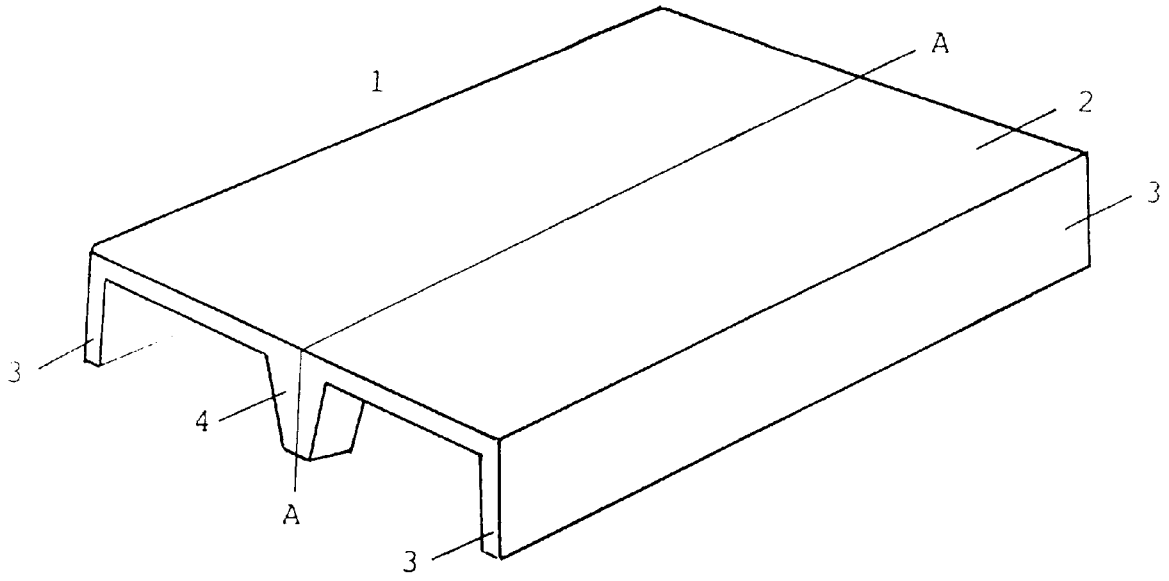
FIG. 1 is a perspective sketch of a fabricated pallet comprising sheet legs and a leg structure consisting of block-shaped posts located in the center longtitudinally.

The present method of manufacturing a pallet comprises a number of steps. The first step consists in extruding a parison, preferably as disclosed in the above mentioned U.S. Pat. No. 4,874,649. The extrudate can have various wall thicknesses around its periphery, obtained by the use of an extrusion die of a suitable configuration. Thus, different parts of the pallet can be given different wall thicknesses. The extruded parison is flattened, and, when still hot, shaped in a mold to a substantially flat article. Parts of the article can be given a desired shape, e.g. profiled structures, deep-drawn posts, etc. by utilizing combinations of compressed air and vacuum. When the parison is laid flat, those parts of the insides forced into contact with each other will become welded together and form a double sheet. The principles of extrusion and forming are well known to persons skilled in the art.

In its simplest embodiment the parison consists of a homogeneous (solid) material. In order to make the extruded structure lighter, the parison can be coextruded with several layers, where at least one layer is at least partially foamed. Present-day coextrusion technology permits a number of options for the shape and structure of the parison. For instance, the extruded structure can in one specific embodiment of the invention consist of a foamed plastic layer having a solid skin on just one side. The foam should preferably have a closed-cell structure, and in practice it can have a density of down to approximately 100 kg/m$^3$. The skin will form the pallet's outsides, so that a wear-resistant and easy-to-clean surface is attained.

With another specific embodiment of the invention, the extruded structure comprises a foamed plastic layer having a solid skin on both sides, or optionally multiples of such a multi-layer structure. Such a sandwich structure will, it is common knowledge, have high torsional rigidity and produce a lightweight construction. The foam layer typically comprises about 70% of the sheet structure's thickness, and each skin layer about 15%, more preferably about 80% and about 10%, respectively. Because the foam has a closed-cell structure, in some cases it can even constitute the entire wall thickness. The foam can have a density within the range of from the density of a solid material down to as far as it is possible in practice to produce a stable polymeric foam. There has to be very good adhesion between the foam and skin layer in order to attain an optimal rigid structure. Consequently, the foam and skin have to be coextruded in such a way that an integrated multilayer structure is produced.

Suitable materials for producing the extruded parison having a multilayer structure comprise in principle all extrudable thermoplastics having sufficient rigidity. Especially suited thermoplastics are polyolefins, polyvinyl chloride (PVC), acrylonitrile butadiene (ABS), styrene plastics, polyamides (PA) and polycarbonates (PC). Of these, polyolefin materials are preferred. However, there is nothing to prevent the foam material and the skin layer(s) from being made of different materials. For instance, an inside and outside layer of ultra-high molecular weight high-density polyethylene (HDPE-HMW) and an intermediate layer of foamed HDPE will comprise a suited structure. Another structure has an inside layer of PP homopolymer, an outside layer of PP block copolymer, and an intermediate layer of foamed PP. Of course, other structures are also possible and fall within the scope of the invention.

The materials constituting the solid part of the extruded multilayer structure can, if desired, be reinforced with cut glass fibers and/or long glass fibers in the direction of extrusion.

During extrusion of the parison and forming of the components of the pallet, manufacturing waste will be produced which, for economic reasons, should be returned to production. This can be done by incorporating the waste material into one or more layers in the coextruded multilayer structure. Consequently, in a practical embodiment of the invention, it will be advantageous to use materials that can be mixed with one another. Polyolefin materials are excellently suited in this respect, especially certain types of polypropylene (PP) and high-density polyethylene (HDPE). Smaller amounts of glass fibers in the skin layers can after grinding of the material be re-extruded and without problems included in the skin layers, and even in the foam layer(s).

It is also possible to add to the thermoplastics crosslinking agents in order to crosslink the material in the pallets produced. The disadvantage is that this kind of manufacturing waste cannot be recycled. Another disadvantage is that the pallets then as a rule can be joined together only mechanically, though there do exist silane-based crosslinking agents that can be crosslinked after the finished pallet has been made.

It is of course possible to add to the plastic materials the additives and auxiliary agents that are customary for thermoplastics, such as antistatic agents, heat and UV stabilizers, colorants, etc. The various layers of the multilayer structure can be of dissimilar colors, as desired. It is also possible that pallets intended for dissimilar purposes can have different colors.

Figure 2:
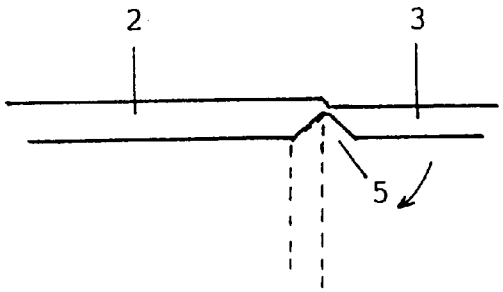
FIG. 2 indicates the principle of how the sheet legs are provided.

According to the method of the invention the pallet deck and the precursor pallet legs intended to be along the sides of the pallet are formed in one forming step into one predominantly flat article. In this forming step V-shaped grooves will also be impressed into the sheet in the whole length thereof in the direction of extrusion and/or in its transverse direction at specific distances from the sides of the sheet. These grooves are given a bottom angle of approximately 90°, as indicated in FIG. 2, as well as a suitable depth; however, the sheet must not break during the subsequent handling. When the sheet has been cooled down and demolded, the side parts of the formed article are bended along said V-grooves to a position perpendicular to the main sheet and fastened in this position. The fastened side sheets will thus become one set of integrated pallet sheet legs, in this patent also termed auxiliary legs, made from the same sheet structure as the rest of the article, i.e. the pallet deck.

It should be obvious to everyone that any combination of sheet-like legs in the longitudinal and/or transverse directions of the pallet is contemplated by the present invention. To ensure that the pallet are able to carry greater loads, legs which will carry the substantial part of the load must be provided along the pallet's center longitudinally. However, in a particular embodiment of the pallet, sheet legs are provided along its longitudinal as well as transverse sides. The fields of use of such a pallet will normally not require any additional pallet legs in its center longitudinally. In another embodiment of the pallet it has auxiliary sheet legs along two of the opposite sides only. In this case load-carrying legs on the bottom of the deck at equal distances from and parallel to said sheet legs will normally be required. Such legs may be of various constructional designs.

Preferred embodiments of the pallet will now be explained in more detail with reference to the attached drawings.

FIG. 1 shows one particular embodiment of the finished pallet, 1, with the pallet deck, 2, auxiliary sheet legs, 3, and leg members comprising more block-shaped pallet legs, of which only one is seen in the figure.

FIG. 2 demonstrates the principle of forming the sheet legs. During the forming of the parison V-shaped grooves, 5, are impressed into the sheet in the whole length thereof at specific distances from its edges. After the formed sheet has been removed from the mold, the side parts, 3, of the sheet are bended along the V-shaped grooves until in a position perpendicular to the main sheet and they are then fastened in this position. This operation is indicated by the dotted lines in FIG. 2. Thus, the main sheet, 2, will constitute the pallet deck and the side parts, 3, will constitute the sheet legs.

The thickness of the main sheet is preferably greater than the thickness of the side sheet parts, 3. This difference in thicknesses is achieved by regulating the circumferential thicknesses of the parison, as explained above, and make the final dimension adjustments in the forming tool. This thickness difference will contribute to obtain a rounded off transitional part between the pallet deck and the sheet legs.

Figure 3:
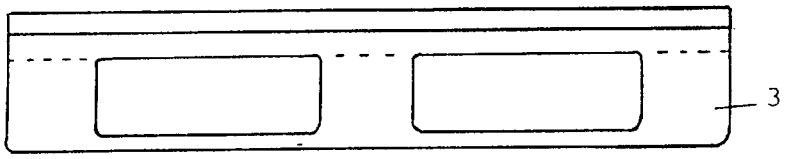
FIGS. 3 and 4 are sectional views showing alternative designs of the plate-shaped legs.
Figure 4:
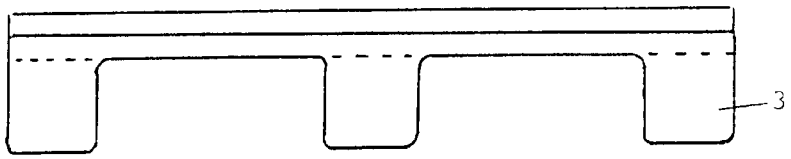

The pallet normally requires openings in the sheet legs so truck forks are allowed to be easily inserted so the pallet can be easily lifted and transported. FIG. 3 shows one embodiment of the sheet legs, 3, that are provided with approximately rectangular openings having rounded off corners. Obviously, the openings can be of any suitable shape. Another embodiment of the auxiliary sheet legs is shown in FIG. 4, where said openings are expanded out through the bottom edge of the side sheet, resulting in three separated sheet legs, optionally two interspaced auxilliary sheet legs at each end of the sheet. The desired openings in the side sheets are marked during forming in the mold by impressing the contours of the opening and after the pallet has been formed the indicated parts are forced out.

Figure 5:
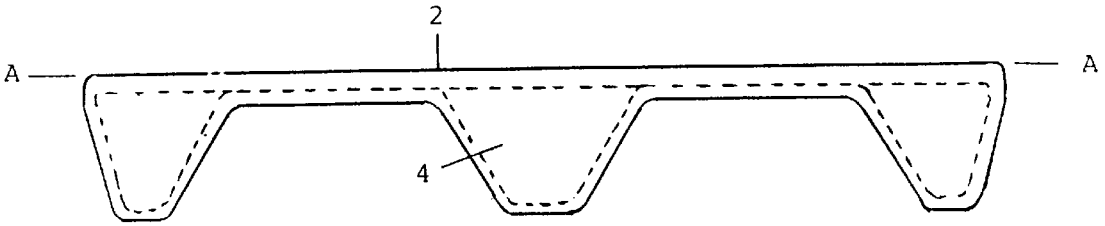
FIG. 5 is a sectional view through the center longitudinally of a pallet having legs consisting of deep-drawn posts.

In the embodiment of the pallet shown in FIG. 1, posts which will constitute one set of pallet legs are deep-drawn in the bottom of the pallet deck in its center longitudinally and parallel to the auxiliary sheet legs. In FIG. 1 only one post at one end of the pallet can be seen. Normally, there are three deep-drawn posts evenly distributed along the center line of the pallet, one post at each end of the pallet and one in its center. This is indicated in FIG. 5, which is a sectional view which runs through the pallet at section A—A in FIG. 1. The posts, 4, can be deep-drawn in one operation to their final depths, thus constituting one set of final block-shaped pallet legs. The disadvantage of deep-drawing said pallet legs to full depths is that the wall thicknesses in the bottom corners of the posts will become small. The properties of the material from which the pallet is manufactured determine the allowed deep-draw ratios, wall inclinations, shape of corners, etc. The problems related to deep-drawing thermoplastics are well known to persons skilled in the art.

Figure 6:
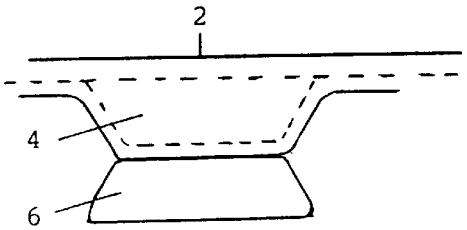
FIG. 6 is a sectional view through a block-shaped pallet leg of an alternative design.

An optional embodiment of the block-formed pallet legs is shown in FIG. 6. Each post, 4, is deep-drawn to a depth less than the final depth, for example to half the height of the final pallet leg. To the bottom of said half-sized posts, 4, separately produced blocks, 6, are then fastened in a particular operation. In principle, said blocks may be of any shape and produced from any material, provided that they can be permanently fastened to the bottoms of the half-sized posts. The blocks, 6, must have such a height that they, when combined with the deep-drawn posts, 4, produce pallet legs of correct heights. The advantage of this embodiment is that the necessary deep-draw ratios of the posts become smaller, and the pallet legs will become stronger.

Figure 7:
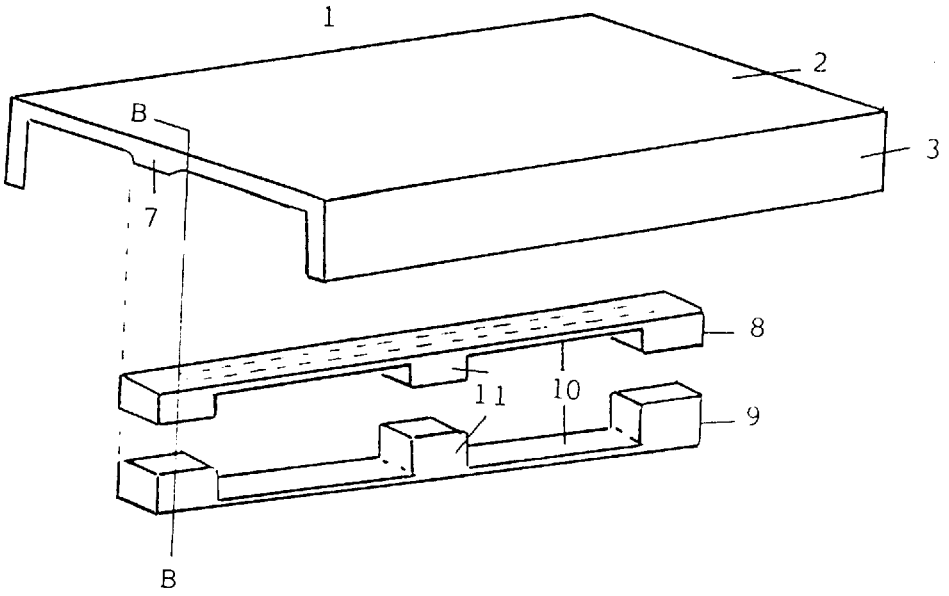
FIG. 7 is a perspective sketch of a pallet deck and runner components prior to joining together.

An embodiment that constitutes an alternative to the embodiment in FIG. 6 comprises the fastening of a separately produced lower runner component, 9, which is shown in FIG. 7, to the posts, 4. This runner component consists of a cross member, 10, having two or more upward-facing posts, 11, which are fastened by their tops to the bottoms of the posts, 4, deep-drawn in the deck, 2.

FIG. 7 shows an embodiment of the pallet where a continuous U-shaped profile, 7, is thermo-formed in the bottom of the deck in the whole length thereof in its center longitudinally and parallel to the auxiliary sheet legs, 3. Two runners, 8 and 9, are fastened to the bottom of said U-shaped profile. Each runner is manufactured in a particular operation by forming a parison into a cross member, 10, with posts, 11. The upper runner component is fastened by its cross member, 10, to the bottom of the U-shaped profile, 7. The lower runner component, 9, is fastened by the tops of its posts, 11, to the bottom of the matching posts, 11, on the upper runner component, 8.

Figure 8:
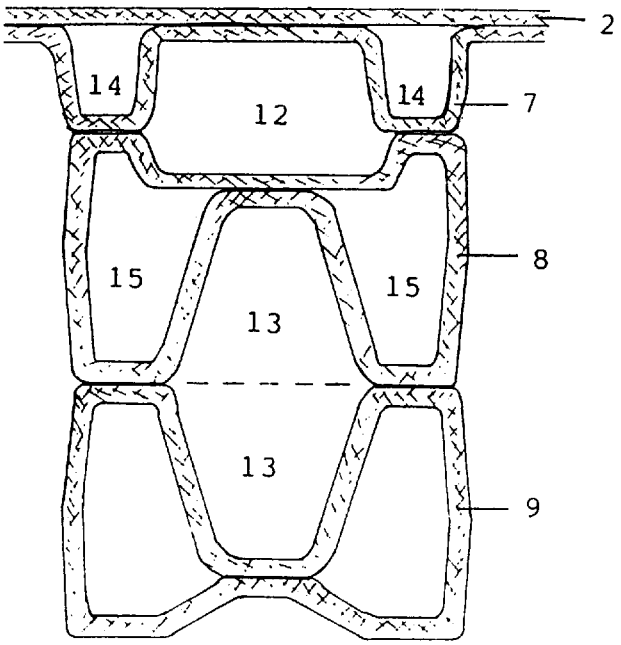
FIG. 8 is a sectional view through a part of the pallet deck and runner components fastened to the bottom of the deck along its center longitudinally.

FIG. 8 is a sectional view through the finished pallet, 1, at section B—B in FIG. 7. The section runs through the pallet deck, 2, the U-shaped profile, 7, and posts, 11, on the upper runner component, 8, and lower runner component, 9. The U-profile, 7, is formed into a channel, 12, and two closed hollow spaces, 14. The upper runner component, 8, is shaped so that a channel is formed on the top of the cross member and longitudinally, that has the same width as the channel, 12, in the bottom of the U-profile. Consequently, a closed channel, 12, extending longitudinally along the pallet is created when the pallet deck, 2, and the upper runner component, 3, are joined together. The channel's length, width and depth can be made to fit the requirements. The U-profile, 7, and the upper runner component, 8, are formed so that each channel, 12, is sealed at each end so that a closed hollow space is created. Optionally, the forming can be such that the channel is open at both ends. The lower runner component, 9, is in principle formed like the upper runner component, 8, but so that the cross member, 10, constitutes the surface facing the floor. Each post on the upper and lower runner components, 8 and 9, is formed as a symmetric profile so that two like-shaped hollow spaces, 15, and a channel, 13, are created, that will also create a closed hollow space. The shape of the pallet's posts can differ designwise from that sketched in FIG. 8 by variations in the dimensions of the channel, 12, and hollow spaces, 13 and 15. However, the bearing walls in the posts must be formed so that a sufficiently rigid structure is attained.

In its simplest embodiment the pallet has sheet-like legs both along its longitudinal and transverse sides, and no legs in the center on the bottom. The sheet-like legs are joined together in the corners of the pallet to obtain a rigid construction.

To stabilize the auxiliary legs it may be convenient in specific fields of use to provide runners in the transverse direction of the pallet fastened to the bottoms of the sheet legs. This is particularly appropriate when the sheet legs have openings cut through their edges, for example three separated sheet legs along each longitudinal side of the pallet. To the bottoms of each pair of opposite sheet legs one runner is fastened in the transverse direction of the pallet. The height of a possible leg structure in the center of the pallet must then be adapted to the respective runners. The runners may be similar to the the runner, 9, shown in FIG. 7. In a preferred embodiment of the pallet on the bottom of the deck in its center there are deep-drawn half-sized post, 4, as shown in FIG. 6. Each runner on the bottom of the pallet in its transverse direction is in its center furnished with a post matching post 4 of the pallet, while the posts at the ends of the cross member will be of a low height adapted to the bottoms of the auxiliary sheet legs, 3. The bottom part of the cross member of the runner component, 10, will face the floor.

The individual components of the pallet can be jointed together most expediently by welding, preferably by butt welding, but other methods of joining like extrusion welding, the use of glue or adhesive, and mechanically joining, can also be employed.

A suitable stiffening section can be inserted into the channel, 12, in FIG. 8, to ensure that the pallet does not deflect at its center under great stress. It is preferable to use sections made of a lightweight metal, plywood or suitable plastic materials, in order to keep down the pallet's unloaded weight.

Because articles made from plastic materials have a slippery surface, and especially articles made from polyolefins like HDPE and PP, it will often be desirable to add to the pallet deck a friction-increasing material. This can be done by extruding an extra layer with a friction material on the outside of the parison in a width from narrow strips to a continuous facing around the entire periphery of the parison or around parts of its periphery. The friction material on the top of the pallet deck will prevent goods from sliding off the pallet, while the friction strips on the bottom will prevent the pallet from sliding easily off truck forks when the pallet is being handled. Alternatively, the friction material coating may be applied onto the pallet deck of already fabricated pallets. This can easily be performed by extrusion coating, for instance by conveying the pallets underneath a stationary extruder in a coating line.

Preferably the friction material is applied to the pallet in the form of parallel, raised longitudinal sections having a height of approximately 1 mm (0.04 in.) and in a width from narrow strips to a continuous facing. When the pallet is fabricated from a polyolefin material, a suitable friction material is selected among polyolefin-containing materials such as EVA, EBA and the like.

The pallet's smooth and even surface makes it very simple and easy to clean and disinfect. The pallet is therefore especially well suited for use in the food industry and allied industries. The pallet has a great strength/weight ratio because of its design. As a result it is well suited for purposes where low weight is important, e.g. in air freight, and where manual handling of pallets occur frequently.

In the foregoing preferred embodiments of the pallet have been explained in reference of pallets having a rectangular shape. Obviously, the pallets may be of a square shape or any other suitable geometrical shape. Further, references to longitudinal sides and transverse sides of the pallet can be interchanged without deviating from the scope of the invention. When the pallet is worn-out it can simply be recycled along the line of other thermoplastic articles.

We claim:

1. A method of manufacturing a plastic pallet comprising a deck and legs disposed underneath said deck for supporting said deck, the method comprising the steps of:

producing in a mold an extruded parison, while hot, into a predominantly flat article comprising a pallet deck, said pallet deck comprising top and bottom surfaces, substantially parallel, opposed longitudinal sides, and substantially parallel, opposed transverse sides, said predominantly flat article further comprising a plurality of sheet legs, one said sheet leg disposed along and integral with at least each said longitudinal side or each said transverse side of said pallet deck, removing said flat article from said mold, rotating said sheet legs while integral with said pallet deck into a position perpendicular to said top surface of said pallet deck, and affixing said sheet legs into said position perpendicular to said top surface, said sheet legs affixed in said position for supporting said pallet deck.

2. The method of claim 1, further comprising the step of forming in said bottom surface of said pallet deck at least two pallet deck posts, said pallet deck posts to function as load-carrying pallet legs, said pallet deck posts being situated at a longitudinal center of said bottom surface of said pallet deck and parallel to one said sheet leg.

3. The method of claim 2, wherein in said forming step said pallet deck posts (4) are block-shaped and are deep-drawn to a depth less than the final height of the plastic pallet, the method further including the step of fastening to a bottom surface of said block-shaped posts separately produced leg structures, said leg structures being of a height that when fastened to said pallet deck posts (4) pallet legs of a desired height are obtained.

4. The method of claim 3, wherein in said fastening step said separately produced leg structures comprise blocks (6) which are fastened to said bottom surface of said block-shaped pallet deck posts (4).

5. The method of claim 3, wherein in said fastening step said separately produced leg structures comprises a separately thermo-formed runner component shaped as a cross-member (10) having at least two upward-facing runner posts (11), and wherein said runner component is fastened by a top surface of said runner posts to said bottom surfaces of said pallet deck posts (4).

6. The method of claim 1, wherein one set of sheet legs (3) is produced and wherein said method further comprises the step of thermo-forming a U-shaped profile (7) in the bottom surface of said pallet deck in the whole length thereof in its centre longitudinally and parallel to said sheet legs, and fastening to the bottom of said U-shaped profile (7) one separately manufactured pallet leg structure comprising upper and lower runner components, said upper runner component (8) comprising a cross member (10) having downward-facing posts (11), and said lower runner component (9) comprising a cross member (10) having upward-facing posts (11), and said upper runner component is fastened by its said cross member to a bottom surface of said U-shaped profile (7), and said lower runner component is fastened by top surfaces of its said upward-facing posts to bottom surfaces of matching said downward-facing posts (11) on said upper runner component.

7. The method of claim 6, wherein at least one of said upper runner component (8) and said U-shaped profile (7) facing said upper runner component are formed with a longitudinal recess, so that a straight open channel (12) is created between said upper runner component and said pallet deck, into which a stiffening section may optionally be inserted.

8. The method of claim 1 wherein said sheet legs (3) include openings to allow truck forks to be inserted.

9. The method of claim 8 wherein said openings are expanded out through the bottom edge of said side sheets to create at least two interspaced auxiliary sheet legs (3).

10. (Once Amended) The method of claim 9 wherein one runner component is fastened to a bottom of each pair of said sheet legs along opposite sides of said pallet deck, each said runner component (9) being produced separately and comprising posts (11) of heights adapted to the sheet legs (3).

11. (Twice Amended) The method of claim 1 wherein in said producing step said parison is extruded from a thermoplastic selected from polyolefins, PVC, ABS, styrene plastics, PA or PC.

12. The method of claim 11 wherein in said producing step said parison is a coextruded integrated multilayer structure comprising at least one foamed layer having a solid skin on both sides.

13. The method of claim 11 wherein said thermoplastic material is at least one polyolefin material.

14. The method of claim 11 wherein said thermoplastic material is reinforced with a material selected from cut glass fibers and long glass fibers.

15. The method of claim 1 wherein in said producing step a polyolefinic material having a high coefficient of friction is coextruded onto at least a part of the periphery of said parison.

16. The method of claims 1 further comprising the step of applying sections made of a friction material to the plastic pallet by extrusion coating said friction material onto said pallet deck of the plastic pallet.

17. The method of claim 15 wherein in said applying step said friction material is applied to said pallet deck as parallel, raised longitudinal sections of approximately 1 mm height and a width of from narrow strips to a continuous facing.

* * * * *

UNITED STATES PATENT AND TRADEMARK OFFICE

CERTIFICATE OF CORRECTION

PATENT NO. : 5,922,269
DATED : July 13, 1999
INVENTOR(S) : Oddbjorn Gronnevik, et. al.

It is certified that error appears in the above-identified patent and that said Letters Patent is hereby corrected as shown below:

The Title page should be deleted and substitute therefor the attached Title page.

Signed and Sealed this

Thirteenth Day of June, 2000

*Attest:*

*Attesting Officer*

Q. TODD DICKINSON

*Director of Patents and Trademarks*

United States Patent [19]

Gronnevik et al.

[11] Patent Number: 5,922,269

[45] Date of Patent: Jul. 13, 1999

[54] PLASTIC PALLET

[75] Inventors: Oddbjorn Gronnevik, Nesbru; Helge Grande; Rolf Kotterheinrich, both of Stathelle, all of Norway

[73] Assignee: Borealis A/S, Lyngby, Denmark

[21] Appl. No.: 08/739,643

[22] Filed: Oct. 30, 1996

Related U.S. Application Data

[60] Provisional application No. 60/013,398, Mar. 14, 1996.

[30] Foreign Application Priority Data

Mar. 6, 1996 [NO] Norway ..... 960910

[51] Int. Cl.[6] ..... B29C 43/00

[52] U.S. Cl. ..... 264/500; 264/241; 264/510; 264/512; 264/514; 264/531; 264/540; 264/543

[58] Field of Search ..... 108/51.1, 51.3; 428/172; 264/171.12, 500, 454, 510, 512, 514, 531, 540, 543, 241, 523

[56] References Cited

U.S. PATENT DOCUMENTS

| | | | |
|---|---|---|---|
| 2,503,022 | 4/1950 | Benoist et al. | 248/120 |
| 3,667,403 | 6/1972 | Angelbeck, Jr. | 108/58 |
| 3,719,157 | 3/1973 | Arcocha et al. | 108/51 |
| 3,868,915 | 3/1975 | Hafner | 108/51 |
| 3,880,092 | 4/1975 | Seeber et al. | 108/55 |
| 3,915,098 | 10/1975 | Nania | 108/51 |
| 3,938,448 | 2/1976 | Nishitani et al. | 108/58 |
| 4,007,694 | 2/1977 | Fowler | 108/55.1 |
| 4,397,246 | 8/1983 | Ishida et al. | 108/55.3 |
| 4,397,247 | 8/1983 | Lemelson | 108/57.1 |
| 4,874,649 | 10/1989 | Daubenbuchel et al. | 428/36.5 |
| 5,046,434 | 9/1991 | Breezer et al. | 108/51.1 |
| 5,052,307 | 10/1991 | Morrison | 108/53.1 |
| 5,417,167 | 5/1995 | Sadr | 108/51.1 |
| 5,555,820 | 9/1996 | Shuert | 108/561 |

FOREIGN PATENT DOCUMENTS

| | | |
|---|---|---|
| 0 400 640 | 5/1990 | European Pat. Off. . |
| 226505 | 6/1997 | European Pat. Off. . |
| 2612153 | 9/1988 | France . |
| 385 207 | 1/1976 | Sweden . |
| 501 539 | 3/1995 | Sweden . |
| 685549 A5 | 10/1992 | Switzerland . |
| 1292136 | 10/1972 | United Kingdom . |
| WO 93/18906 | 9/1993 | WIPO . |

*Primary Examiner*—Donald Loney
*Attorney, Agent, or Firm*—Kirkpatrick & Lockhart LLP

[57] ABSTRACT

A method of manufacturing a plastic pallet having a deck and legs underneath the deck includes forming an extruded parison, while still hot, into an article having a pallet deck and integrated sheet legs along its longitudinal, transverse, or both sides. The formed article is removed from the mold and the formed sheet legs are brought into a position perpendicular to the pallet deck and then are fastened in that position.

17 Claims, 3 Drawing Sheets

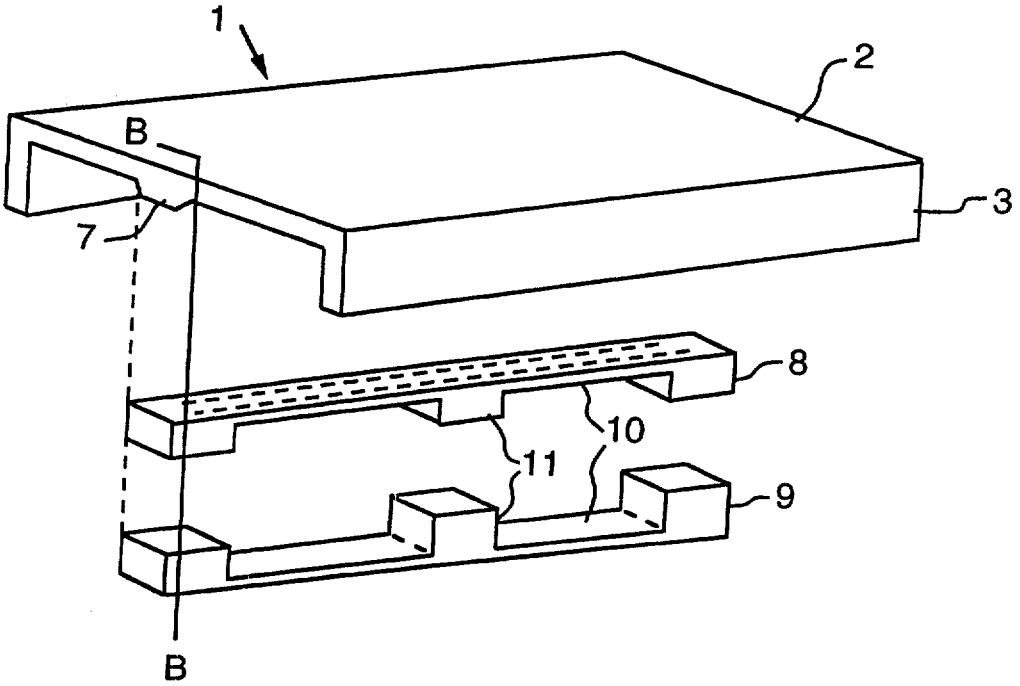

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 1 of 3, figure 1, the drawing should appear as follows:

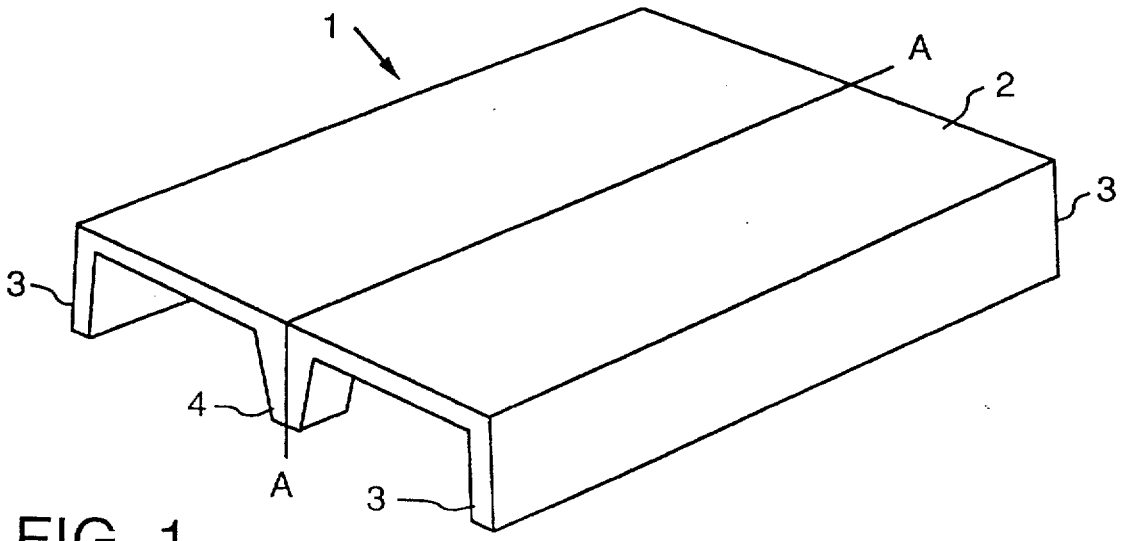

FIG. 1

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 1 of 3, figure 2, the drawing should appear as follows:

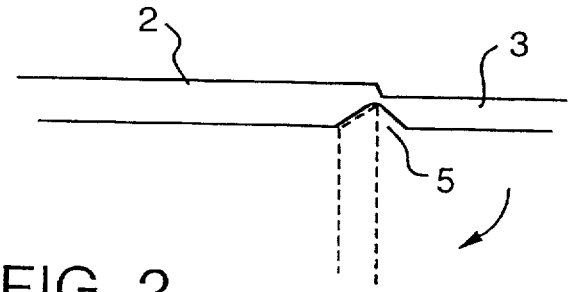

FIG. 2

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 2 of 3, figure 3, the drawing should appear as follows:

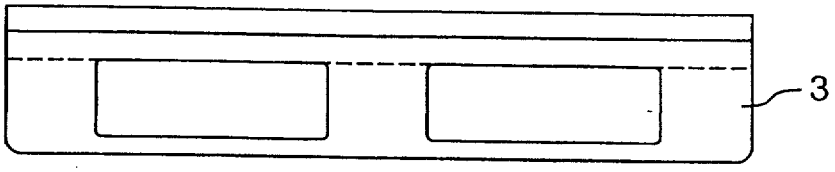

FIG. 3

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 2 of 3, figure 4, the drawing should appear as follows:

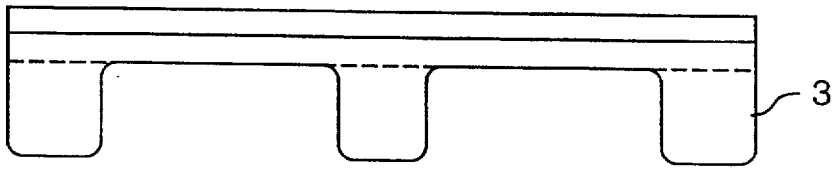

FIG. 4

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 2 of 3, figure 5, the drawing should appear as follows:

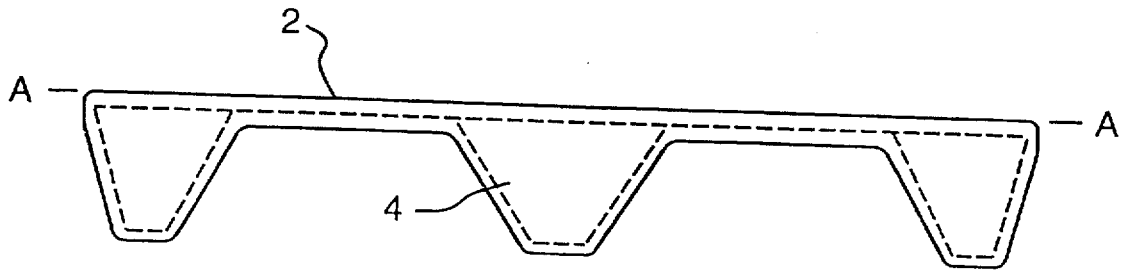

FIG. 5

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 2 of 3, figure 6, the drawing should appear as follows:

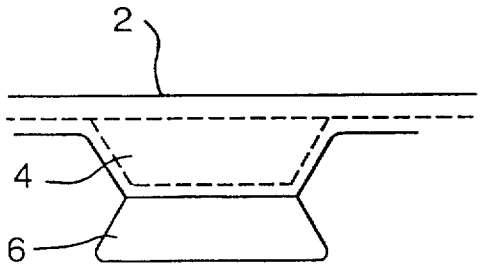

FIG. 6

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 3 of 3, figure 7, the drawing should appear as follows:

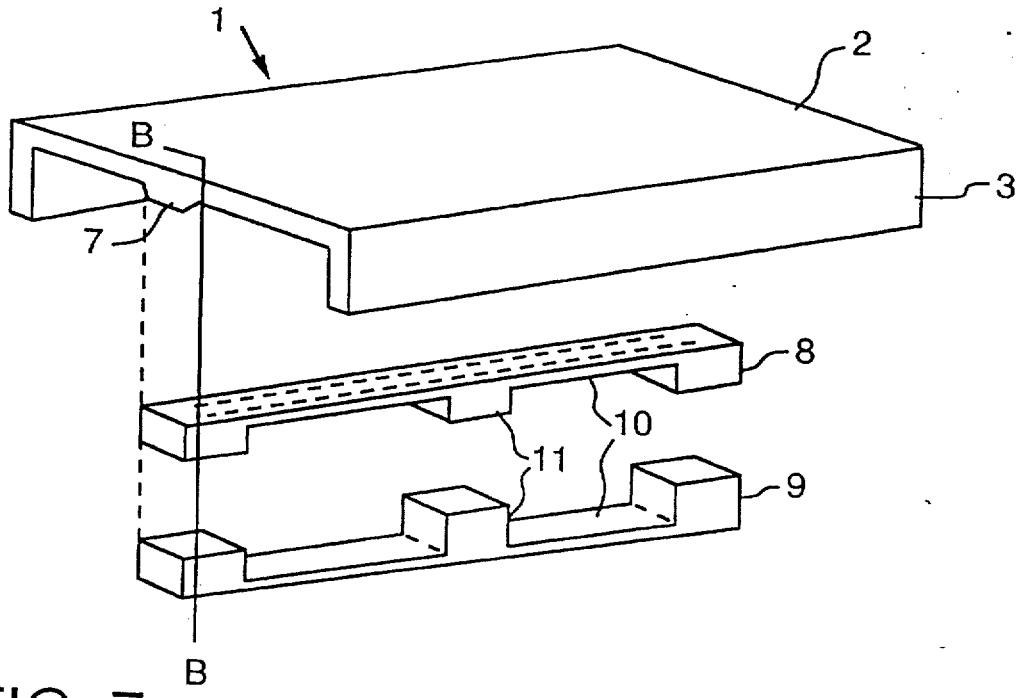

FIG. 7

UNITED STATES PATENT AND TRADEMARK OFFICE

CERTIFICATE OF CORRECTION

PATENT NO. : 5,922,269

DATED : July 13, 1999

INVENTOR(S) : Gronnevik et al.

It is certified that error appears in the above-identified patent and that said Letters Patent is hereby corrected as shown below:

In the drawings, Sheet 3 of 3, figure 8, the drawing should appear as follows:

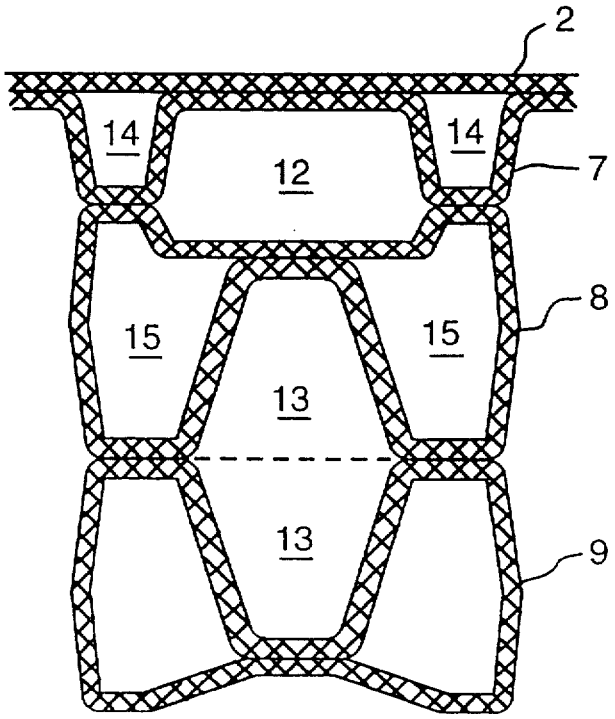

FIG. 8

UNITED STATES PATENT AND TRADEMARK OFFICE

CERTIFICATE OF CORRECTION

PATENT NO : 5,922,269

DATED : July 13, 1999

INVENTOR(S) : Gronnevik, et al.

It is certified that error appears in the above-identified patent and that said Letters Patent is hereby corrected as shown below:

In claim 10, line 1, delete "(Once Amended)".

In claim 11, line 1, delete "(Twice Amended)".

Signed and Sealed this

Twelfth Day of December, 2000

*Attest:*

Q. TODD DICKINSON

*Attesting Officer*

*Director of Patents and Trademarks*